United States Patent [19]

Briner et al.

[11] Patent Number: 4,646,513

[45] Date of Patent: Mar. 3, 1987

[54] METHOD FOR PIECING A YARN IN A FRICTION SPINNING DEVICE

[75] Inventors: Emil Briner, Winterthur; Urs Keller, Seuzach, both of Switzerland

[73] Assignee: Maschinenfabrik Rieter AG, Winterthur, Switzerland

[21] Appl. No.: 874,521

[22] Filed: Jun. 16, 1986

[30] Foreign Application Priority Data

Jun. 24, 1985 [DE] Fed. Rep. of Germany ..... 3522556

[51] Int. Cl.[4] ..... D01H 15/02; D01H 7/882

[52] U.S. Cl. ..... 57/263; 57/22

[58] Field of Search ..... 57/22, 261, 263, 400, 57/401

[56] References Cited

U.S. PATENT DOCUMENTS

| | | | |
|---|---|---|---|
| 3,640,059 | 2/1972 | Lutovsky et al. | 57/263 |
| 4,083,171 | 4/1978 | Konig et al. | 57/263 |
| 4,356,692 | 11/1982 | Karl et al. | 57/263 |
| 4,485,615 | 12/1984 | Pigalev et al. | 57/22 X |
| 4,501,116 | 2/1985 | Schuller et al. | 57/263 |
| 4,598,539 | 7/1986 | Stahlecker et al. | 57/263 |

FOREIGN PATENT DOCUMENTS

| | | |
|---|---|---|
| 3318687 | 11/1984 | Fed. Rep. of Germany . |
| 3317369 | 11/1984 | Fed. Rep. of Germany . |
| 3338833 | 5/1985 | Fed. Rep. of Germany . |
| 3401316 | 7/1985 | Fed. Rep. of Germany . |

*Primary Examiner*—Donald Watkins
*Attorney, Agent, or Firm*—Werner W. Kleeman

[57] ABSTRACT

To piece up a yarn in a friction spinning device, fibers supplied to a yarn formation position of a friction spinning drum are twisted to form a twisted fiber structure until the latter has sufficient strength for grasping by a suction device moved towards the twisted fiber structure end opposite to yarn withdrawal. The suction device grasps this end and stops such twisted fiber structure. Further fibers wound about the now substantially stationary twisted fiber structure strengthen the so it can be withdrawn by the suction device. Due to such withdrawal and constant further supply of fibers, a yarn-like structure is formed adjoining the twisted fiber structure and such yarn-like structure is also withdrawn. To subsequently again form the actual yarn, withdrawal rollers are engaged so the yarn produced at the yarn formation position is withdrawn at production speed or with a reduced speed still sufficient for forming a yarn. Then the twisted fiber structure and the adjoining yarn-like structure are taken-up by the suction device. Thereafter, taken-up yarn can be transferred to a wind-up device. In the event of a yarn break, the newly-produced yarn is supplied at its yarn end to a yarn-connecting or piecing device which also simultaneously receives a yarn end from the unfinished package. The two yarn ends are interconnected and during such time, the continuously delivered, newly-produced yarn is taken-up by an intermediate storage device, the stored yarn being taken-up again by the package after connection of the two yarn ends.

13 Claims, 6 Drawing Figures

METHOD FOR PIECING A YARN IN A FRICTION SPINNING DEVICE

CROSS REFERENCE TO RELATED APPLICATION

This application is related to the commonly assigned, co-pending U.S. patent application Ser. No. 0/6 874,522, filed June 16, 1986, and entitled "Friction Spinning Device Containing A Friction Spinning Means And Method Of Use Of The Friction Spinning Device".

BACKGROUND OF THE INVENTION

The present invention relates to a new and improved method of piecing a yarn in a friction spinning device in which freely-floating fibers are delivered in a fiber feed passage or channel to a friction spinning surface of a friction spinning means, and are transported on this friction spinning surface to a yarn formation location, from which a yarn is withdrawn.

The previously known methods and devices for the abovementioned piecing of a yarn use a yarn end drawn back from a package, which end is inserted into the stationary friction spinning means for piecing purposes so that yarn piecing is thereafter carried out at a reduced speed of the friction spinning device by feeding fibers to the returned yarn end. It has also been suggested that, before piecing, i.e. before feeding the freely-floating fibers to the inserted yarn end, the latter be untwisted by rotating the friction spinning means in the opposite direction, in order to thereby produce a better binding or interlacing of the delivered fibers with the yarn end.

A device of this general type is known from the German Patent Publication No. 3,318,687, in which a yarn end from a reverse-rotated package is taken up by a suction device, and the yarn drawn in by suction is held by two reciprocating devices in the converging gap of two stationary friction spinning drums. Before supplying freely-floating fibers to this yarn, the latter is opened or loosened by reverse rotation of the friction spinning drums, so that the fibers of the yarn lie substantially in a twist-free manner in the converging gap of the friction spinning drums. Thereafter, the friction spinning drums are set in rotation in the normal direction of rotation and at reduced speed, and freely-floating fibers are supplied to the opened yarn, the yarn thereby produced being withdrawn at a correspondingly reduced speed and fed to a connecting or piecing device or means. In order to take up the yarn continually delivered during the time required for the yarn piecing operation, the delivered yarn is taken in by a suction nozzle functioning as a yarn storage device. After completion of yarn piecing, the complete device is accelerated to operating speed and thereafter is disconnected from the required auxiliary drive means and is driven at operational speed by the normal drive means. The disadvantages of such a device lie in the multiplicity of auxiliary devices for the piecing operation.

SUMMARY OF THE INVENTION

Therefore, with the foregoing in mind, it is a primary object of the present invention to provide a new and improved method for piecing yarn which does exhibit the aforementioned drawbacks and shortcomings of the prior art.

Another and more specific object of the present invention aims at providing a new and improved method for piecing yarn in a friction spinning device which piecing operation can be carried out with a minimum of auxiliary piecing devices.

Yet a further significant object of the present invention aims at providing a new and improved method of the character described which is relatively simple in concept, economical to employ, reliable in application, not readily subject to malfunction and requires a minimum of attention.

Now in order to implement these and still further objects of the invention, which will become more readily apparent as the description proceeds, the method of the present invention is manifested by the features that it comprises the steps of supplying, during yarn piecing, further fibers to a yarn formation position or location and twisting the further fibers into an intertwined or twisted or coiled fiber structure of substantially predetermined size, subsequently grasping the intertwined or twisted or coiled fiber structure by a gripping means, substantially fixedly holding or immobilizing and withdrawing the intertwined or twisted or coiled fiber structure in a yarn withdrawal direction until the intertwined or twisted or coiled fiber structure is located outside the yarn formation position, and subsequently sucking away the intertwined or twisted or coiled fiber structure and a yarn-like structure which is subsequent to or adjoins the intertwined or twisted or coiled fiber structure.

The advantages achieved by the invention are essentially that a device for carrying out the method can be made relatively simple as a result of the possibility of performing yarn piecing at production speed.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
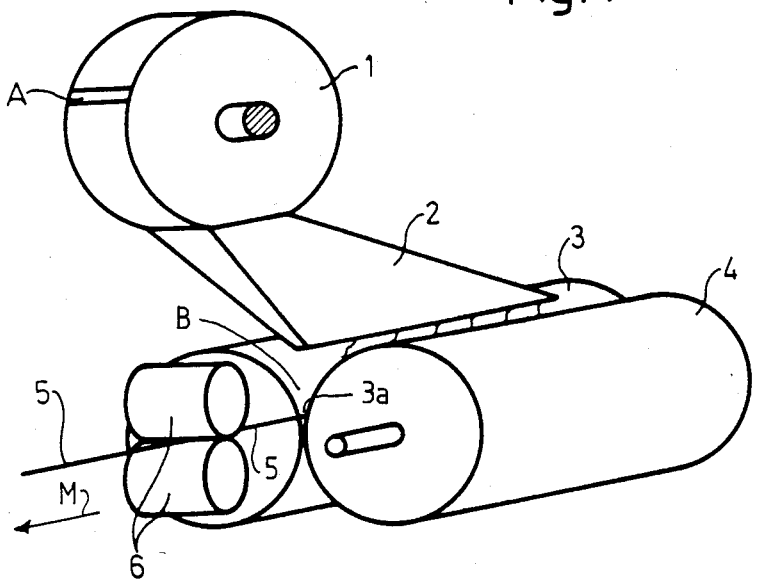
FIG. 1 shows a friction spinning device in normal operation, illustrated schematically in perspective view.

Describing now the drawings, it is to be understood that to simplify the showing thereof only enough of the structure of the friction spinning device has been illustrated therein as is needed to enable one skilled in the art to readily understand the underlying principles and concepts of this invention. Turning now specifically to FIG. 1 of the drawings, the apparatus illustrated therein by way of example and not limitation and employed for performing the method of the invention will be seen to comprise an opening roller 1 which is known to the art from rotor open-end spinning techniques. The opening roller 1 has an infeed opening A for receiving a not particularly shown fiber lap or web or the like. The infeed opening A delivers freely-floating fibers by means of an adjoining fiber feed passage or channel 2 to a perforated rotatable and drivable friction spinning drum 3 defining a perforated friction spinning element. A counter-roller 4, which is also drivable and rotatable and also defines a friction spinning element, is arranged in immediate proximity and essentially parallel to the perforated friction spinning drum 3, yet without contacting this perforated friction spinning drum 3. The counter-roller 4 serves as an aid for imparting twist to the fibers twisted to a yarn 5 in the converging space or nip B of the opening roller 1 and the counter-roller 4. The spun yarn 5 is withdrawn by a withdrawal roller pair 6. Such devices are known to the art from previous publications in the patent literature and are therefore not here further described.

Figure 2:
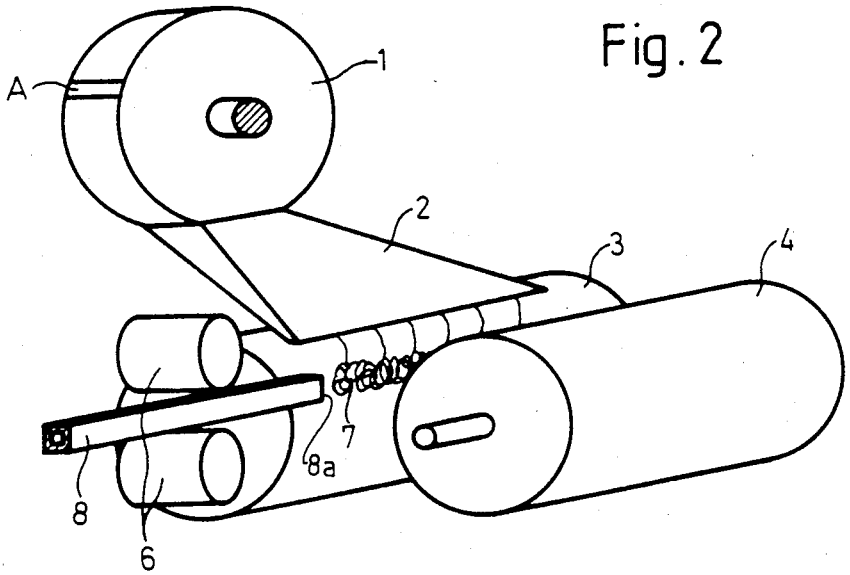
FIGS. 2 to 6 show the friction spinning device of FIG. 1 during various method steps of yarn piecing.

In the following, the procedure for piecing during start up, as well as the procedure for piecing after a thread or yarn break, will be described:

As illustrated in FIG. 2, during the initial or start-up yarn piecing operation fibers are first fed onto the friction spinning drum 3, although these fibers are initially not withdrawn as a yarn. Thus, a rotating loosely intertwined or twisted or coiled fiber structure 7—hereinafter generally referred to as a twisted fiber structure—of continuously increasing size is formed. After this rotating twisted fiber structure 7 has taken up an adequate quantity of fibers which cohere to some extent, a suction device 8, defining a gripper device, is moved towards this rotating twisted fiber structure 7 in a direction which is opposed to a yarn withdrawal direction M. The counter-roller 4 may be moved laterally away from the perforated friction spinning roller 3 in order to permit entry of the suction device 8 into the yarn formation position or location 3*a* for engaging the twisted fiber structure 9. Movement of the twisted fiber structure 7 continues until the rotating twisted fiber structure 7 is held at the corresponding leading or outbound end by the opening 8*a* of the suction device 8 without the rotating twisted fiber structure 7 being drawn into this suction device 8. In this way, the rotating twisted fiber structure 7 is brought to a standstill or immobilized from its secured end, so that the continuously delivered fibers wind about this now substantially stationary twisted fiber structure 7 and impart to the twisted fiber structure 7 increased strength.

Figure 3:
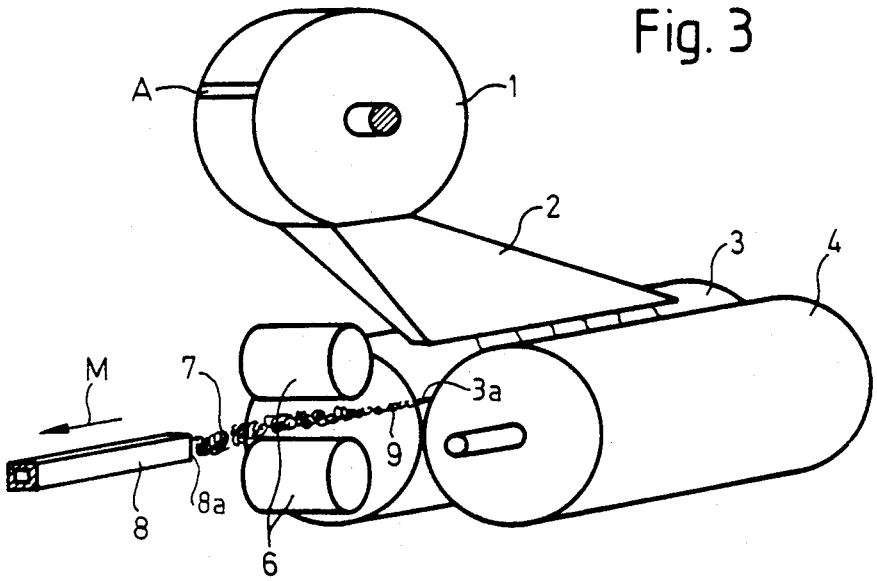

Thereafter, the twisted fiber structure 7 is withdrawn from a yarn formation position or location or zone, generally indicated by reference character 3*a*, in the yarn withdrawal direction M by the suction device 8, whereupon a yarn-like structure 9 subsequently adjoins this twisted fiber structure 7. The last-mentioned condition is illustrated in FIG. 3. The yarn-like structure 9 is withdrawn from the yarn formation position or location 3*a* at only the speed of the suction device 8, since the withdrawal rollers 6 are still located in a spaced or open disposition and are thus not capable of withdrawing the yarn-like structure 9 located between them at a speed corresponding to that of production of a yarn.

Figure 4:
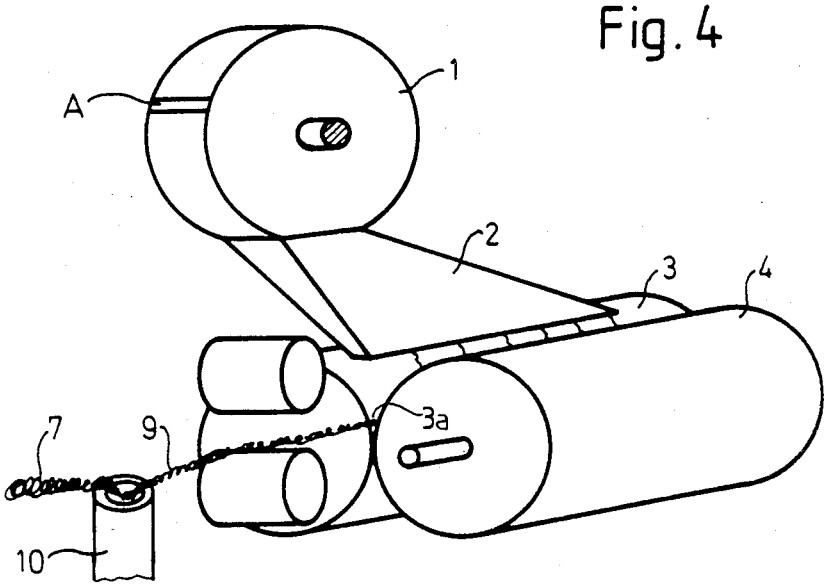
Figure 5:
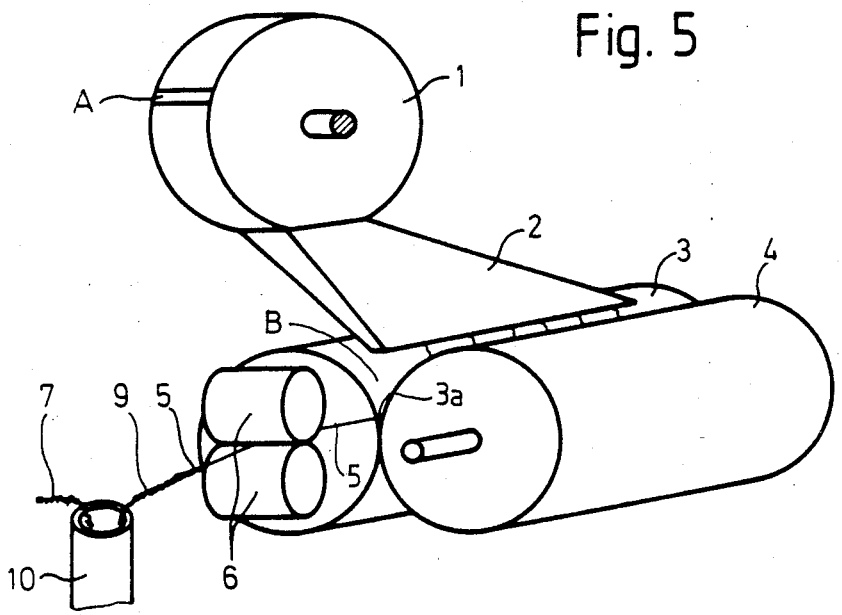
Figure 6:
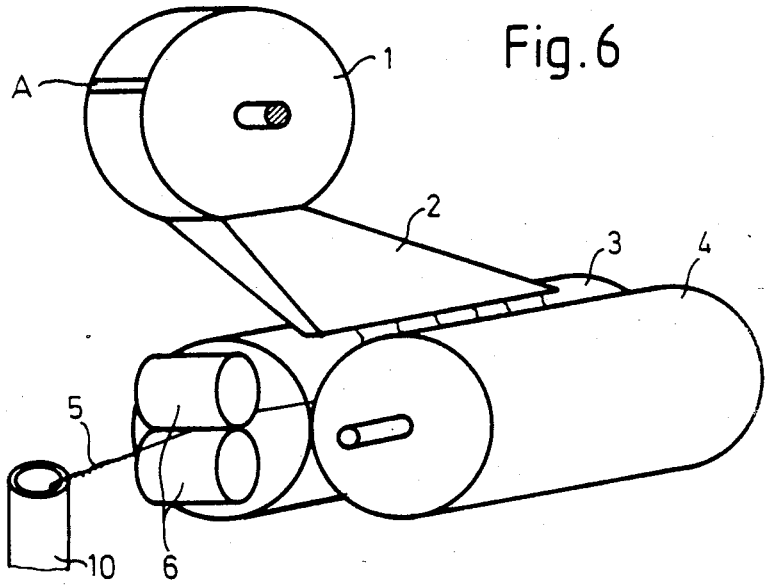

From this stage onwards, initial yarn piecing can be carried out in two possible embodiments, the second embodiment being illustrated in FIGS. 4 to 6.

The first embodiment is not further illustrated, but will be simply described in the following:

subsequent to the stage illustrated in FIG. 3, the opening 8*a* of the suction device 8 is increased by suitable not particularly shown means, so that the suction device 8 is capable of drawing in the twisted fiber structure 7. Simultaneously, the upper roller (as viewed in the Figures) of the two withdrawal rollers 6 is pressed against the lower roller (as illustrated in FIGS. 1, 5 and 6), so that the yarn-like structure 9 is now withdrawn at production speed and, correspondingly, a normal yarn with the desired yarn thickness is formed, that is, the suction device 8 now takes up the yarn 5 at production speed.

Thereafter, the yarn 5 is guided by the suction device 8 into a suitable not particularly shown conventional wind-up device or winder in order to transfer the yarn 5 to this wind-up device for winding up.

In the embodiment illustrated in FIGS. 4 to 6, in place of an enlargement of the opening 8*a* of the suction device 8 for taking up the twisted fiber structure 7 itself, a second suction device 10, defining a gripper device, is provided which takes up the twisted fiber structure 7 from the suction device 8 which previously simply held the twisted fiber structure 7. The second suction device 10 draws in the yarn-like structure 9 which follows or subsequently adjoins the twisted fiber structure 7. Simultaneously, the withdrawal rollers 6 are closed or engaged, as illustrated in FIG. 5, that is, the withdrawal rollers 6 are pressed towards each other, whereupon the yarn 5 is withdrawn from the yarn formation position or location 3*a* at production speed and is taken up by the second suction device 10. The term "yarn formation position" or "yarn formation location" or equivalent terminology refers to that section of the fiber-receiving friction roller or perforated friction spinning drum 3 at which the fibers are formed in a known manner into the twisted fiber structure 7, or into the yarn-like structure 9 or into the yarn 5.

In a manner similar to that described for the first embodiment, this second suction device 10 is now guided towards a suitable not particularly shown conventional wind-up device or winder in order to transfer the yarn to this wind-up device.

In the event of a yarn break, the yarn cannot simply be supplied to a wind-up device as in the previously mentioned cases, but the newly produced yarn must be connected with a yarn end located on the unfinished package.

The yarn newly delivered by the friction spinning device or means is therefore guided either by means of the suction device 8 or by means of the second suction device 10 to a suitable not particularly shown conventional connecting or piecing device. Yarn drawn back from the unfinished package is also brought to the piecing device. This can take place before the arrival of the newly delivered yarn, simultaneously therewith or thereafter. The yarn withdrawn from the package is then connected or pieced together with the newly produced yarn.

The connection or piecing operation can be effected by tying or by splicing. However, both procedures require the processed yarn ends to be held stationary, that is the continuously delivered, newly-produced yarn must be fed in the meantime to a suitable not particularly shown yarn store or storage device until the connecting or piecing procedure has been completed. Depending upon the type of storage device, the yarn can be taken up either at production speed or at a speed which is reduced relative to the production speed but is still adequate for the formation of a yarn. The yarn store can be in the known form of a suction nozzle or a drum storage, for example as shown in German Pat. Publication No. 2,558,419 to which reference may be readily had and the disclosure of which is incorporated herein by reference.

Thereafter, the rotating package in the wind-up device takes up the yarn from the yarn storage device at production speed.

It will be clear that the described method can also be carried out with friction spinning devices which comprise suitable friction spinning discs or plates in place of friction spinning drums. The fibers are transported to the discs and the yarn is formed by the discs at a yarn formation position or location and is withdrawn therefrom by withdrawal rollers. A suitable example of such a device is illustrated and described, for example, in the British Patent No. 1,231,198, to which reference may be readily had and the disclosure of which is incorporated herein by reference.

Also, a suitable correspondingly perforated band or belt can be used in place of a friction spinning drum or disc. The fibers are supplied to the band or belt at a yarn formation position lying at right angles to the movement of the band or belt in order to produce a yarn. A suitable example of such a device, including such a band or belt, is illustrated, for example, in the French Published Patent Application No. 2,480,799, to which reference may be readily had and the disclosure of which is incorporated herein by reference.

Furthermore, in place of the first suction device 8 a suitable not particularly shown mechanical gripper can be used in combination with the second suction device 10. The gripper must simply be able to grasp the twisted fiber structure 7 in the aforedescribed manner, in order to bring it to a standstill and to withdraw it from the yarn formation position so that thereafter the twisted fiber structure 7 can be transferred to the second suction device 10.

Furthermore, if the first suction device 8 is formed as an appropriate twist-imparting means, then the arrangement could be such that the twisted fiber structure 7 is not simply made stationary but is set into rotation in the opposite direction so that the now reverse rotating twisted fiber structure 7 is provided with greater strength due to twisting together. Such suction devices comprise a twist-imparting infeed opening and constitute a type well-known in this art.

Finally, it will be understood that the opening of the withdrawal rollers 6, and the shifting or displacement of the counter-roller 4 illustrated in FIG. 2 for insertion of the first suction device 8, are both not necessary if the twisted fiber structure 7 is drawn out or withdrawn by another kind of means or facility, for example, suitable not particularly shown manually guided means. It is clear that in this case the previously-mentioned piecing method can be carried out manually or mechanically. In the event of manual piecing, therefore, the opening of the withdrawal rollers 6 must be effected at the earliest when the yarn 5 or the yarn-like structure 9 is to be inserted between them.

While there are shown and described present preferred embodiments of the invention, it is to be distinctly understood that the invention is not limited thereto, but may be otherwise variously embodied and practiced within the scope of the following claims. Accordingly,

What we claim is:

1. In a method for piecing a yarn in a friction spinning device, comprising the steps of:

supplying fibers to a yarn formation position of a friction spinning surface of a friction spinning device and twisting said fibers to form a twisted fiber structure of substantially predeterminate size;

subsequently grasping said twisted fiber structure;

holding and withdrawing said twisted fiber structure in a yarn withdrawal direction until said twisted fiber structure is located outside said yarn formation position; and subsequently sucking away said twisted fiber structure and a yarn-like structure subsequently adjoining said twisted fiber structure.

2. The method as defined in claim 1, further including the steps of:

withdrawing the yarn-like structure at a predeterminate speed; and subsequently increasing the withdrawal speed of said yarn-like structure to a speed substantially corresponding to that of production of a yarn for forming and sucking away a yarn which is produced by the friction spinning device.

3. The method as defined in claim 1, further including the steps of:

grasping the twisted fiber structure by a gripping means; and the step of sucking away said twisted fiber structure and said subsequently adjoining yarn-like structure is carried out by said gripping means.

4. The method as defined in claim 1, further including the steps of:

grasping the twisted fiber structure by means of a gripping means comprising a suction nozzle; and said step of sucking away of said twisted fiber structure and said subsequently adjoining yarn-like structure is carried out by a separate, additional suction device.

5. The method as defined in claim 1, further including the steps of:

grasping the twisted fiber structure by means of a gripping means comprising a mechanical gripper; and said step of sucking away of said twisted fiber structure and the subsequently adjoining yarn-like structure is carried out by a suction device.

6. The method as defined in claim 1, further including the steps of:

forming a yarn which subsequently adjoins the yarn-like structure at the friction spinning surface of the friction spinning device;

withdrawing the formed yarn by suction; and transferring said yarn withdrawn by suction to a wind-up device.

7. The method as defined in claim 1, further including the steps of:

forming a yarn which subsequently adjoins the yarn-like structure at the friction spinning surface of the friction spinning device;

withdrawing the formed yarn by suction;

transferring said yarn withdrawn by suction to a yarn piecing means; and piecing said transferred yarn in said yarn piecing means with a second yarn withdrawn from a package to form a pieced yarn.

8. The method according to claim 7, wherein:

said piecing is carried out by tying.

9. The method as defined in claim 7, wherein:

said piecing is carried out by splicing.

10. The method as defined in claim 7, further including the steps of:

subsequently transferring said pieced yarn to a wind-up device.

11. The method as defined in claim 10, further including the steps of:

transferring said yarn to a yarn storage device before transfer to said yarn piecing means;

said yarn storage device taking up said yarn during the piecing operation; and said yarn storage device thereafter furnishing said yarn to said wind-up device.

12. The method as defined in claim 7, further including the steps of:

accomplishing piecing at the production speed of the friction spinning device.

13. In a method for piecing a yarn in a friction spinning device, comprising the steps of:

supplying fibers to a yarn formation position of a friction spinning surface of a friction spinning device and twisting said fibers to form a twisted fiber structure of substantially predeterminate size;

subsequently grasping said twisted fiber structure;

holding and withdrawing said twisted fiber structure in a yarn withdrawal direction until said twisted fiber structure is located outside said yarn formation position, and subsequently removing said twisted fiber structure and a yarn-like structure subsequently adjoining said twisted fiber structure.

* * * * *

UNITED STATES PATENT OFFICE
CERTIFICATE OF CORRECTION

PATENT NO. : 4,646,513
DATED : March 3, 1987
INVENTOR(S) : EMIL BRINER et al.

It is certified that error appears in the above-identified patent and that said Letters Patent are hereby corrected as shown below:

Abstract, line 9, after "the" please insert --latter--

Column 1, line 66, after "does" please insert --not--

Signed and Sealed this

First Day of September, 1987

*Attest:*

*Attesting Officer*

DONALD J. QUIGG

*Commissioner of Patents and Trademarks*